United States Patent [19]

Freismuth

[11] 3,965,224

[45] June 22, 1976

[54] CARBURETOR CHOKE VALVE POSITIONER

[75] Inventor: Richard J. Freismuth, Mount Clemens, Mich.

[73] Assignee: Ford Motor Company, Dearborn, Mich.

[22] Filed: Apr. 1, 1974

[21] Appl. No.: 457,049

[52] U.S. Cl. ..... 261/39 B; 261/52

[51] Int. Cl.[2] ..... F02M 1/10

[58] Field of Search ..... 261/39 B, 52

[56] References Cited

UNITED STATES PATENTS

| | | | |
|---|---|---|---|
| 2,408,104 | 9/1946 | Stanton | 261/39 B X |
| 2,946,577 | 7/1960 | Dennison et al. | 261/52 X |

*Primary Examiner*—Tim R. Miles
*Assistant Examiner*—William Cuchlinski, Jr.
*Attorney, Agent, or Firm*—Robert E. McCollum; Keith L. Zerschling

[57] ABSTRACT

A carburetor has a choke apparatus including a pulldown servo to crack open the choke valve a predetermined amount once the engine has attained a running condition, to lean the air/fuel mixture. The conventional bimetallic spring is included to slowly open the choke valve wider. A locking lever is provided to lock the choke valve against return to a more closed position than that attained by the pulldown servo, to prevent stalls due to cold engine loading and loss of vacuum; the lever, however, freely permitting opening of the choke valve and also including means to reset the locking lever so that the engine can be restarted with a closed choke valve.

9 Claims, 3 Drawing Figures

CARBURETOR CHOKE VALVE POSITIONER

This invention relates, in general, to a carburetor for a motor vehicle engine. More particularly, it relates to an automatic choke to provide cold weather starts of an engine, while at the same time minimizing the output of undesirable emissions.

As ambient temperature drops, friction within the engine and the viscosity of the lubricants increase significantly. Therefore, at low temperatures, the speeds at which an engine normally would idle must be increased to prevent stalling. Accordingly, a choke mechanism is provided to richen the fuel/air mixture supplied to the engine during cold starting and engine warm-up.

Generally, the choke apparatus includes a coiled thermostatic spring that operatively rotates the choke valve towards a closed or nearly shut position with decreasing temperatures, and permits the progressive opening of it as the temperature returns towards a chosen level. A manifold suction responsive pulldown servo generally overrides the coil spring force and cracks open the choke a predetermined angle of say twenty degrees, for example, when the engine starts, to provide a leaner running mixture. The choke action provides a richer than normal mixture so that sufficient fuel can be vaporized to permit smooth starting and running of the engine during cold weather.

With the above construction, driveaways under cold ambient conditions often load the engine to the point of stalling. That is, slight loading under these conditions can cause a loss of engine vacuum to the point where the pulldown servo vacuum is insufficient to maintain the choke plate cracked opened the predetermined amount. This results in a further loading of the engine until it stalls.

The invention is directed to a device to minimize the occurrence of the type of stalls described. It consists of a lever that operatively locks the choke valve in the predetermined cracked open position once it has been moved there by the pulldown servo, to eliminate the effect of subsequent loss of pulldown servo vacuum, and yet freely permits further opening of the choke valve by the conventional temperature responsive mechanism.

It is a primary object of the invention, therefore, to provide a carburetor choke mechanism with a device that operates to minimize rich mixture stalls during cold engine driveaways.

It is a further object of the invention to provide a carburetor of the type described above with a locking lever that selectively prevents closing of the choke valve beyond a predetermined amount once it has been moved to that position by engine vacuum.

It is a still further object of the invention to provide a carburetor choke apparatus that includes an engine vacuum operated pulldown piston with a locking lever that, first, is movable into position once the choke valve has been opened by the pulldown piston to lock the choke valve against closing, to prevent engine stalls upon subsequent decay in engine vacuum; and, secondly, can be moved by the vehicle driver out of locking position so that the choke valve can be reset to a more closed engine cranking position.

Other objects, features and advantages of the invention will become more apparent upon reference to the succeeding, detailed description thereof, and to the drawings illustrating the preferred embodiment thereof, wherein.

Figure 1:
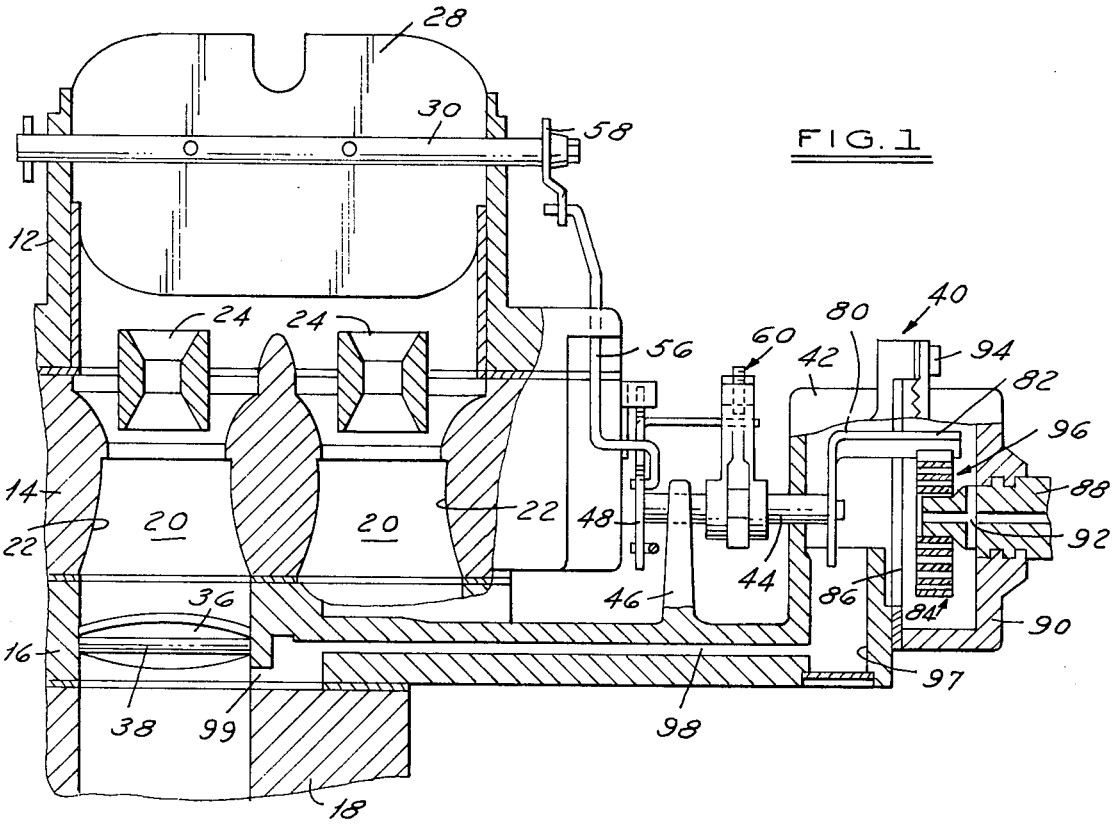
FIG. 1 is a cross-sectional view of a portion of a carburetor embodying the invention.

FIG. 1 is obtained by passing a plane through approximately one-half of a known type of two-barrel, downdraft type carburetor. The portion of the carburetor shown includes an upper air horn section 12, an intermediate main body portion 14, and a throttle valve flange section 16. The three carburetor sections are secured together by suitable means, not shown, over an intake manifold indicated partially at 18 leading to the engine combustion chambers.

Main body portion 14 contains the usual air-fuel mixture induction passage 20 having fresh air intakes at the air horn ends, and connected to manifold 18 at the opposite ends. The passages are each formed with a main venturi section 22 containing a booster venturi 24 suitably mounted for cooperation therewith, by means not shown.

Air flow through passage 20 is controlled in part by a choke valve 28 unbalance mounted on a shaft 30 rotatably mounted on side portions of the carburetor air horn, as shown. Flow of fuel and air through each passage 20 is controlled by a conventional throttle valve 36 fixed to a shaft 38 rotatably mounted in flange portion 16. The throttle valves are rotated in a known manner by depression of the vehicle accelerator pedal, and move from idle speed positions essentially blocking flow through passages 20 to wide open positions essentially at right angles to the position shown.

Choke valve 28 rotates from a closed position to the nearly vertical, essentially inoperative position shown. In this latter position, the choke valve provides the minimum resistance to airflow. The rotative position of choke valve 28 is controlled in part by a semiautomatically operating choke mechanism 40. The latter includes a hollow housing portion 42 that is cast as an integral extension of the carburetor throttle flange. The housing is apertured for supporting rotatably one end of a choke valve control shaft 44. The other end of shaft 44 is rotatably supported in a casting 46. A choke control lever 48 is fixed on the left end portion of shaft 44 and has a finger portion 50. The finger portion constitutes a control for a fast idle cam, to be described. Lever 48 is pivotally connected to the end of a rod 56. Rod 56 at its other end is pivoted to a link 58 fixed on choke valve shaft 30. It will be clear that rotation of shaft 44 in a clockwise direction will rotate choke valve 28 to open the carburetor air intake, while rotation of shaft 44 and lever 48 in the opposite direction will close the choke valve.

Figure 2:
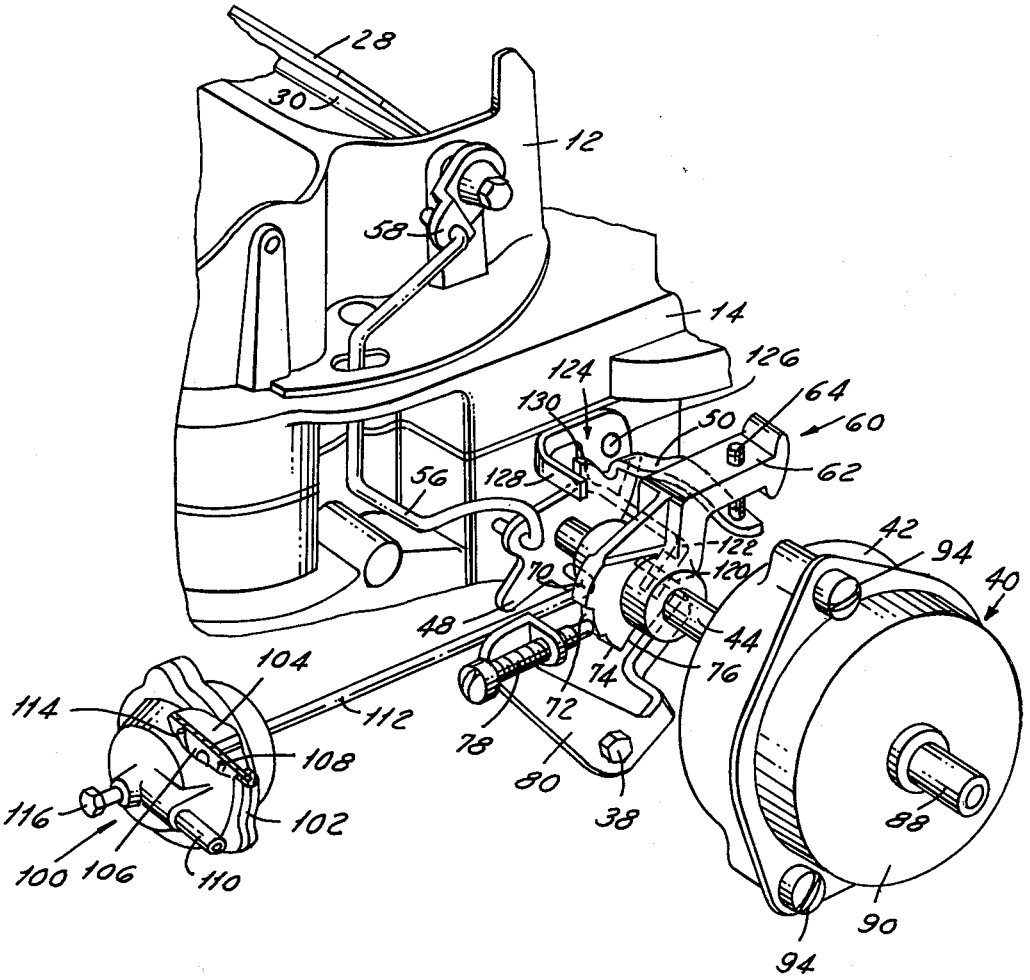
FIG. 2 is a perspective elevational view of the carburetor shown in FIG. 1; and, FIG. 3 is a side elevational view of a portion of the FIG. 2 showing.

During cold engine operation, it is necessary to open the throttle valve to a wider than normal idle speed position to allow sufficient extra air/fuel mixture to prevent the engine from stalling due to the extra friction, greater viscosity of the lubricant, etc. The fast idle cam mechanism automatically accomplishes this as a function of temperature changes. More specifically, as mentioned previously, choke control link 48 has a finger portion 50 adapted to control the movement of a fast idle cam. As best seen in FIGS. 1 and 2, rotatably mounted on shaft 44 is a conventional fast idle cam 60. The cam has a projection 62 on one side in which is adjustably mounted a screw 64. The screw engages the finger portion 50 of lever 48. The projection 62 also contains a recess, not shown, in which is pressed a weight or ball of predetermined mass. The mass and its location is chosen such that cam 60 will always fall by gravity in a clockwise direction to follow the movement of finger portion 50. As will be seen later, this will rotate the cam clockwise progressively as the temperature increases.

The opposite side of cam 60 is formed with an edge having three steps 70, 72 and 74. Each contiguous step in counterclockwise circumferential succession has a face that is of less radial extent than the previous one, the last step 74 being followed by an opening 76. The steps and opening constitute abutments or stops in the path of movement of a screw 78. The screw is adjustably mounted on a lever 80 fixed to throttle shaft 38. The radial depth of opening 76 is chosen such that when the fast idle cam 60 rotates following finger portion 50 to a position engaging the screw 78 in the opening 76, the throttle valve shaft will have rotated the throttle valve to its normal engine idle speed position essentially closing the throttle valve. Engagement of screw 78 with each of the steps 70, 72 and 74, as cam 60 rotates, then will progressively locate the idle speed positions of the throttle valve at a more open position.

Finger portion 50 and lever 48 are rotated by an essentially L-shaped thermostatic spring lever 80 fixedly secured to the righthand end portion of shaft 44 (FIG. 1). Lever 80 has a leg portion 82 secured to the outer end of a coiled thermostatic spring element 84 through an arcuate slot, not shown, in an insulating gasket 86. The inner end portion of the coil spring is fixedly secured on the end of a nipple 88 that is formed as an integral portion of a choke cap 90 of heat insulating material. Nipple 88 is bored as shown to provide hot air passages 92 that are connected to an exhaust manifold heat stove, for example. Cap 90 is secured to housing 42 by suitable means, such as the screw 94 shown, and defines an air or fluid chamber 96. The casting 42 contains a bore 97 that is subject to the vacuum in a passage 98 connected to the carburetor main induction passages 20 by a port 99 located just slightly below the throttle valve 36.

The thermostatic spring element 84 will contract or expand as a function of the changes in ambient temperature conditions of the air entering nipple 88, or, if there is no flow, the temperature of the air within chamber 96. Accordingly, changes in ambient temperature will rotate the spring lever 84 to rotate shaft 44 and lever 48 in one or the other directions, as the case may be.

Gravity causes cam screw 64 to engage finger portion 50 upon opening of the throttle plates by moving lever 80 and thus screw 78 in a counterclockwise direction. This determines which step 70, 72 or 74, or whether opening 76, will be engaged by screw 78, and, therefore, what the idle speed position of throttle valve 36 will be.

A cold engine start of a motor vehicle requires a richer mixture than a warmed engine start because considerably less fuel is vaporized. Therefore, the choke valve should be shut or nearly shut to increase the pressure drop thereacross and draw in more fuel and less air. Once the engine does start, however, then the choke valve should be opened slightly to lean the mixture to prevent engine flooding as a result of an excess of fuel.

FIG. 2 shows the carburetor having a servo device 100 connected to the choke valve link 48. The servo has a hollow housing 102 divided into an air chamber 104 and vacuum chamber 106 by an annular flexible diaphragm 108. The air chamber 104 is vented to the atmosphere through a port not shown. The vacuum chamber is adapted to be connected by a tube 110 to an engine manifold vacuum port (not shown) in the induction passage similar to port 99. The diaphragm 108 is fixed to a rod 112 that is pivotally connected to link 48. A spring 114 normally biases the diaphragm in a rightward direction as seen in FIG. 2 moving link 48 towards the closed choke valve position.

As thus far described, on cold weather starts, the temperature of the air in the thermostatic spring housing chamber 96 will be low so that spring element 84 will contract. This will rotate shaft 44 and lever 48 in a counterclockwise direction to move choke valve 28 to a closed or nearly closed position, as desired. Upon cranking the engine, vacuum in passage 110 will not be sufficient to move diaphragm 110 to open the choke valve. Accordingly, the engine will be started with a rich mixture. As soon as the engine is running, high vacuum in passage 110 moves diaphragm 108 and rod 112 leftwardly to bottom against an adjustable stop 116. This will rotate link 48 clockwise and open the choke valve to a predetermined position so that the mixture is leaned.

Turning now to the invention, the lever 80 is formed with an angled extension 120. The extension at times is adapted to engage the downturned end 122 of a choke valve position locking lever 124. The latter is pivotally mounted on a shaft 126 projecting from the carburetor body. It has a right angled locking tang portion 128 that has a unidirectional engagement with a lug 130 extending from lever 48. The lug 130 has a cam surface 132 upon which the tang portion 128 rests when lever 124 has been rotated clockwise and the lever 48 is in a rotative position slightly counterclockwise from that shown, positioning the choke valve closed.

The parts are so diminished and arranged that the throttle valve shaft lever 80 must be rotated counterclockwise close to a wide open throttle position before its extension 120 engages the end 122 of lever 124. Then lever 124 will be rotated clockwise to lift the locking tang portion 128 out of engagement or abutment position with lug 130. This will then permit servo spring 114 to shut or close the choke valve by rotating lever 48 counterclockwise. Release of the vehicle acceleration pedal then will permit lever 80 to rotate clockwise to return to a fast idle speed position, disengaging extension 120 from the end 122 of lever 124. This then permits the locking lever 124 to fall by gravity in a counterclockwise direction to rest its tang 128 against surface 132.

It will be clear that lever 48 can be rotated freely in a clockwise choke opening direction by the coiled spring 84, but that it is restricted in its return movement by engagement against the tang 128. This will maintain the choke valve open a predetermined amount regardless of a drop in engine vacuum in servo tube 110 to a level below that sufficient to maintain the diaphragm 108 against stop 116. Thus, loading of the engine by premature closing of the choke valve will not occur.

The overall operation is believed to be clear from the preceding description and a consideration of the drawings, and therefore will not be repeated in detail. In brief, assume that the engine is off and ready for a cold engine start. Depression of the vehicle accelerator pedal will pivot the throttle valve shaft 38 and lever 80 counterclockwise to move screw 78 away from the fast idle cam face. This will permit the fast idle cam to fall by gravity in a clockwise direction until the screw 64 engages the finger portion 50 of lever 48.

Simultaneously, the opening wide of the throttle valve shaft will cause the extension 120 of lever 80 to engage the downturned end 122 of the locking lever 124 pivoting the latter clockwise until the locking tang 128 is raised out of engagement with the lug 130 on lever 48. Accordingly, the bimetallic coiled spring 84 and servo spring 114 then can rotate lever 48 counterclockwise to shut the choke valve 28. Release of the accelerator pedal then will permit a clockwise rotation of lever 80 to engage its screw 78 with whichever step 70, 72 or 74 of the fast idle cam is opposite the screw. This then will determine the fast idle opening of the throttle plates. Simultaneously, the return of the accelerator pedal will permit the release of the locking lever 124 to fall by gravity on the contoured surface 132 of lug 130. The engine now is ready for starting or cranking.

Figure 3:
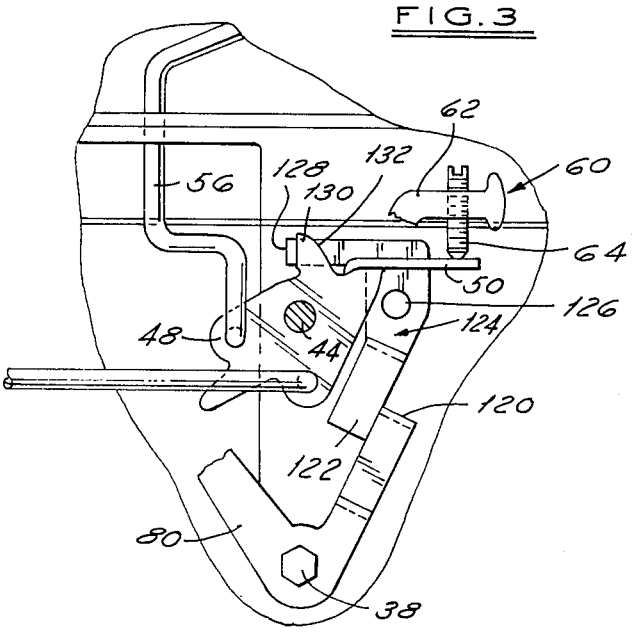

Once the engine has been cranked, engine running vacuum applied through servo tube 110 to diaphragm 108 will move the diaphragm to pivot lever 48 clockwise until the diaphragm bottoms against the stop screw 116. This will move the link 56 and crank open the choke valve 28 a predetermined degree sufficient to lean the mixture to the engine running level desired. Simultaneously, clockwise pivotal movement of lever 48 causes the locking tang 128 to ride on the surface 132 of lug 130 until it moves past the lug and into the position shown in FIG. 3. At this point, therefore, should engine vacuum decrease for any reason, lever 48 will not be able to rotate counterclockwise to close the choke valve beyond the position shown. Accordingly, engine loading due to low vacuum conditions will not occur as a result of inoperativeness of the servo 100.

On the other hand, however, as the engine temperature warms, the thermostatically coiled spring element 84 will rotate the lever 48 clockwise, which is freely permitted by the construction of the locking lug 128. If, for any reason, the vacuum level should decay to a value below that necessary to actuate servo 100, nevertheless, the locking lever 48 will not return the choke valve towards a position more closed than the position shown in FIG. 3. Upon engine shutdown, however, to reposition the choke valve for cold engine starting, the process is repeated by opening the throttle valve sufficient to engage the dechoking end 122 of the locking lever 124 and move it and tang 128 away from the path of movement of lever 48, to permit lever 48 to return to the closed choke position.

From the foregoing, it will be seen that the invention provides a device that will minimize stalls due to engine loading of a cold engine by loss of vacuum, by desensitizing the vacuum responsive means so that its influence at low vacuums is minimal.

While the invention has been shown and described in its preferred embodiment, it will be clear to those skilled in the arts to which it pertains that many changes and modifications may be made thereto without departing from the scope of the invention.

I claim:

1. An automatic choke system for use with a carburetor having an air/fuel induction passage and an unbalance mounted, air movable, choke valve mounted for variable movement across the passage to control airflow through the passage, temperature responsive spring means operably connected to the choke valve urging the choke valve towards a closed position with a force increasing as a function of decreases in the temperature of the spring means from a first predetermined level, power means sensitive to engine manifold vacuum for moving the choke valve from the closed position to a predetermined open position in opposition to the spring means, the predetermined open position being one that is only slightly opened relative to the closed position and less open than the position attained when the engine has reached a normal operating temperature level, and locking means operably engagable with the choke valve and rendered operable at all times once the power means has moved the choke valve to the predetermined position to prevent the choke valve from closing to a lesser open position than the predetermined position upon decay of the manifold vacuum below the level establishing the predetermined position of the choke valve.

2. A choke system as in claim 1, including a rotatable lever connected both to the choke valve and to the temperature responsive means for rotation of the choke valve in open or closed directions as a function of temperature changes, and means connecting the power means to the lever such as to move the lever to move the choke valve towards the predetermined position.

3. A choke system as in claim 2, wherein the locking means includes other means engagable with the lever subsequent to movement of the choke valve to the predetermined position to prevent return movement of the lever in a choke closing direction.

4. A choke system as in claim 3, including further means engagable at times with the other means to disengage the locking means from the lever to permit closing of the choke valve.

5. A choke system as in claim 3, the other means comprising a member having a unidirectional overrunning type engagement with the lever permitting free rotation of the lever in a choke opening direction and a restricted rotation of the lever in the choke closing direction.

6. A choke system as in claim 4, the further means comprising manually operable means movable to disengage the other means from the lever.

7. A choke system as in claim 1, the locking means including a lever fixed to said spring means for movement therewith as a function of temperature changes, means connecting the lever to the choke valve for moving the choke valve in response to movement of the lever, other means connecting the lever to the power means for movement of the lever by the power means to open the choke valve to the predetermined position, a movable locking member adjacent the lever, and one-way interconnecting means connecting the lever and locking member whereby the lever is free to be moved in one direction by the spring means to open the choke valve but is limited in its movement in the opposite direction to prevent closing of the choke valve.

8. A choke system as in claim 7, the one-way interconnecting means including a cam surface on the lever engagable with the locking member upon movement of the lever in a choke opening direction to cam the locking member out of the path of the lever, the lever having a cut-away portion permitting movement of the locking member into the path of return movement of the lever towards the choke closing position upon continued opening choke movement of the lever to the predetermined open position, whereby the lever is thereafter prevented from returning to a choke closed position.

9. A choke system as in claim 8, including selectively operable means engagable with the locking member to move the member away from the path of movement of the lever thereby permitting return movement of the lever in a choke closing direction to a choke closed position.

* * * * *